US005978623A

United States Patent [19]

Itoh

[11] Patent Number: 5,978,623

[45] Date of Patent: Nov. 2, 1999

[54] DEVELOPING APPARATUS

[75] Inventor: Isami Itoh, Mishima, Japan

[73] Assignee: Canon Kabushiki Kaisha, Tokyo, Japan

[21] Appl. No.: 09/248,098

[22] Filed: Feb. 11, 1999

[30] Foreign Application Priority Data

Feb. 17, 1998 [JP] Japan ..... 10-034577

[51] Int. Cl.[6] ..... G03G 15/08

[52] U.S. Cl. ..... 399/104; 399/274

[58] Field of Search ..... 399/98, 102, 103, 399/104, 274, 275, 282, 284

[56] References Cited

U.S. PATENT DOCUMENTS

| | | | |
|---|---|---|---|
| 5,187,326 | 2/1993 | Shirai | 399/104 |
| 5,552,864 | 9/1996 | Malicki et al. | 399/104 |
| 5,781,836 | 7/1998 | Tada et al. | 399/275 |
| 5,790,923 | 8/1998 | Oguma et al. | 399/104 X |
| 5,812,909 | 9/1998 | Oguma et al. | 399/103 |
| 5,913,094 | 6/1999 | Endo | 399/104 |

*Primary Examiner*—Sandra Brase

*Attorney, Agent, or Firm*—Fitzpatrick, Cella, Harper & Scinto

[57] ABSTRACT

The present invention provides a developing apparatus which comprises a rotatable developer bearing member, a rotatable developer regulating member, a first magnetic portion provided in an opposed relation to the developer bearing member in order to prevent the magnetic toner from leaking at ends of the developer bearing member in a rotation axis direction thereof, and a second magnetic portion provided in an opposed relation to the developer regulating member in order to prevent the magnetic toner from leaking at ends of the developer regulating member in a rotation axis direction thereof, and, in the vicinity of the developer regulating portion, the second magnetic portion is disposed inwardly of the first magnetic portion in the rotation axis direction.

6 Claims, 7 Drawing Sheets

DEVELOPING APPARATUS

BACKGROUND OF THE INVENTION

1. Field of the Invention

The present invention relates to a developing apparatus used with an electrophotographic apparatus, an electrostatic recording apparatus or the like.

2. Related Background Art

Conventionally, various electrophotographic methods have been proposed, as disclosed in U.S. Pat. No. 2,297,691, Japanese Patent Publication No. 42-23910 and Japanese Patent Publication No. 43-24748. However, in general, there has been used a method in which an electrostatic latent image is formed on a photosensitive member by means of various means utilizing photo-conductive material and the electrostatic latent image is developed and visualized as a toner image by using toner and after the toner image is transferred onto a transfer material such as a paper sheet the toner image is fixed to the transfer material by heating or solvent vapor, thereby obtaining a copy.

Further, various methods for visualizing the electrostatic latent image by using the toner are already known. For example, there have been proposed various developing method such as a fur brush developing method, a cascade developing method and a liquid developing method, as well as a magnet brush developing method as disclosed in U.S. Pat. No. 2,874,063 and a powder cloud developing method.

Among these developing methods, particularly, the cascade developing method and the magnetic brush developing method using toner and carrier mainly have widely been used. These methods are excellent developing methods capable of providing a high quality image relatively stably.

However, all of the above-mentioned developing methods have common disadvantages such as degradation of the carrier, change in mixing ratio between the toner and the carrier, complexity of the apparatus, scattering of the toner and unevenness stripes due to existence of the carrier, which are inherent to two-component developing agent.

To eliminate the above-mentioned disadvantages, various developing methods utilizing one-component developer consisting of toner have been proposed. For example, U.S. Pat. No. 3,909,258 discloses a developing method using electrically conductive magnetic toner in which the conductive magnetic developer is born on a cylindrical conductive sleeve having a magnet therein and an electrostatic latent image is developed by contacting the sleeve with the latent image. In this case, in a developing portion, toner particles forms a conductive path between a surface of a recording body (photosensitive member) and a surface of the sleeve, and charges are supplied to the toner particles from the sleeve through the conductive path, and the toner particles are adhered to the electrostatic latent image on the recording body by a Coulomb force between the latent image and the toner particles, thereby effecting development. This developing method using the conductive magnetic toner is excellent in the point that the disadvantages of the conventional two-component developing methods can be eliminated, but, has a disadvantage that, since the toner is conductive, it is difficult to electrostatically transfer the developed image from the recording body to a final support member such as a normal paper sheet.

To eliminate this disadvantage, as a developing method using high resistance toner capable of being transferred electrically, Japanese Patent Application Laid-Open No. 52-94140 discloses a developing method utilizing dielectric polarization of the toner particles.

However, this developing method has disadvantages that a developing speed is inherently slow and that density of the developed image is insufficient, and, thus, is hard to be practically used.

As another developing method using the high resistance magnetic toner, a developing method in which toner particles are frictionally charged by friction between the toner particles and friction between the toner particles and a sleeve and the toner particles are contacted with an electrostatic holding member to achieve development has been proposed.

However, this method has disadvantages that poor frictional charging is apt to occur since the number of contacts between the toner particles and the friction member is small and that, if the Coulomb force between the charged toner particles and the sleeve is strong, the toner particles are apt to be aggregated on the sleeve, and, thus, it has been pointed out that this method is hard to be practically used.

To eliminate these disadvantages, a new developing method capable of eliminating the above-mentioned disadvantages has been proposed, as disclosed in Japanese Patent Application Laid-Open No. 54-43036. In this method, after a very thin toner layer is formed on a sleeve by coating and the toner layer is frictionally charged, the toner layer is closely approached to an electrostatic latent image within a magnetic field, thereby achieving development without contact between the toner and the latent image. According to this method, since the magnetic toner is coated as the very thin layer, the chance of contact between the magnetic toner particles and the sleeve is increased, with the result that frictional charges required for development can be applied to the toner particles.

As a result that inventor tested and checked the application of charges in the above-mentioned one component developing method, it was found that movement of the toner particles at the charge applying portion in the one-component developing method becomes as follows.

FIG. 5 shows an example of a developing apparatus using one-component magnetic toner.

Namely, FIG. 5 is a sectional view of a developing apparatus 3 in which a developing sleeve 1*a* formed from non-magnetic material can be rotated in a direction shown by the arrow. A permanent magnet 1*b* is fixed within the developing sleeve 1*a*. The developing apparatus further includes a magnetic blade 2 made of magnetic material, and a convey member 4. The magnetic blade 2 is disposed in such a manner that a distance W between the magnetic blade and the developing sleeve 1*a* becomes constant. Incidentally, in general, in most cases, the distance W is selected to 100 $\mu$m to 1 mm.

In the developing apparatus 3 shown in FIG. 5, one-component magnetic toner T is coated on the developing sleeve 1*a* as a thin toner layer having a thickness which is determined by a position of a cut line L shown in FIG. 7.

According to the inventor's investigation, it was found that the charges are applied to the magnetic toner when the magnetic toner T passes through a space between the developing sleeve 1*a* and the magnetic blade 2. Further, it was found that the movement of the magnetic toner T in this case becomes as follows.

As shown in FIG. 6, among planes perpendicular to a line connecting between the developing sleeve 1*a* and the magnetic blade 2, when it is assumed that the plane nearer to the magnetic blade 2 is S1 and the plane nearer to the developing sleeve 1*a* is S2, generally, since a width of the magnetic blade 2 is smaller than a width of the permanent magnet 1*b*, magnetic flux density on the plane S1 becomes greater than magnetic flux density on the plane S2. Accordingly, the magnetic toner T is subjected to a force directing toward the magnetic blade 2 (shown by the arrows in FIG. 6) between the developing sleeve 1*a* and the magnetic blade 2.

Thus, as shown in FIG. 6, the magnetic toner T forms "ears" (condition shown in FIG. 7) which extend from the magnetic blade 2 to the developing sleeve 1*a*. The application of charges to the magnetic toner T is achieved by increasing density of toner at the ears and by contacting the developing sleeve 1*a* and toner particles t1 on the tip ends of the ears formed from the magnetic blade 2 to apply charges to the toner particles.

Further, it was found that conveyance of toner between the developing sleeve 1*a* and the magnetic blade 2 is effected as follows.

As mentioned above, since the charges are applied to the toner particles t1 (on the tip ends of the ears) contacted with the developing sleeve 1*a*, the toner particles are subjected to a force (generated by a mirror symmetry force (mirroring force)) directing toward the developing sleeve 1*a* and are also subjected to a conveying force (due to a frictional force between the toner particles and the developing sleeve 1*a*) directing toward a rotational direction of the developing sleeve 1*a*.

Further, since there is a certain cohesive force between the toner particles, toner particles t2 contacted with the toner particles t1 are also subjected to the conveying force due to the presence of the cohesive forces. Similarly, toner particles t3 (on the upper surface of the toner layer) are also subjected to the conveying force due to the presence of the cohesive forces.

However, as mentioned above, since there is the magnetic force directing toward the magnetic blade 2 between the developing sleeve 1*a* and the magnetic blade 2, the toner ears are cut at a location where the conveying force overcomes the magnetic force (i.e., on the cut line L shown in FIG. 7), with the result that only the toner particles remaining on the developing sleeve 1*a* are conveyed toward the rotational direction of the developing sleeve 1*a*.

Accordingly, in systems wherein the magnetic toner cohesive force is great or in systems wherein magnetic toner having the greater number of contacts for obtaining the required amounts of frictional charges is used, toner particles not contacted with the developing sleeve and having poor charges are conveyed to a developing area, thereby creating a poor image due to poor charging.

To avoid this inconvenience, the inventor has proposed a developing apparatus 3 (as shown in FIG. 8) comprising developer including magnetic toner, a rotatable developing sleeve (developer bearing member) 1*a* for bearing the magnetic toner on a surface thereof, a permanent magnet 1*b* disposed within the developing sleeve 1*a*, and a developer regulating member 6*a* for regulating a coated amount of the magnetic toner, wherein at least two conveying forces directing in opposite directions are applied to the magnetic toner at a developer regulating portion, and, at least one of the conveying forces is a force for conveying the toner toward a developing area and mainly depends upon a charged amount of the toner, and, the other conveying force (acting toward a direction opposite to the developing area) depends upon a rotational force and a magnetic force acting from the developer regulating member 6*a* to the magnetic toner, so that non-charged magnetic toner is not subjected to the conveying force directing toward the developing area. As a result, only the sufficiently charged magnetic toner is coated on the surface of the developing sleeve 1*a* uniformly, with the result that only the sufficiently charged magnetic toner can be conveyed to the developing area. Incidentally, in FIG. 8, the reference numeral 9 denotes a photosensitive drum as an electrostatic latent image bearing member.

In association with such a developing device 3, the inventor has proposed a magnetic seal member 7 (as shown in FIG. 9) made of magnetic material and adapted to cover peripheries of the developing sleeve 1*a* and the developer regulating member 6*a* in a "3"-shaped (inverted E shaped) manner, as an end toner leakage preventing member of non-contact type.

At an edge portion A of the developer regulating member 6*a* side shown in FIG. 8, the magnetic seal member 7 shown in FIG. 9 serves to coat the magnetic toner on the developer regulating member 6*a* at an area having a width equal to a width of the magnetic seal member 7 in the same manner that the toner is coated by the magnetic blade 2 at a magnetic pole portion N61 within the developer regulating member 6*a*. The coated magnetic toner is returned to a developing container while passing through a space or gap between the developing sleeve 1*a* and the developer regulating member 6*a* and is restrained again at an edge portion B of the magnetic seal member 7 in the space between the developing sleeve 1*a* and the developer regulating member 6*a*, thereby preventing toner leakage at the edge portion of the developer regulating member 6*a*.

Further, regarding the developing sleeve 1*a* side, the edge portion B of the magnetic seal member 7 in the space between the developing sleeve 1*a* and the developer regulating member 6*a*, a phenomenon similar to the toner coating of the magnetic blade 2 is generated so that the toner is coated on the developing sleeve 1*a*, and the coated toner is restrained again at an edge portion C of the magnetic seal member 7, thereby preventing toner leakage at the edge portion of the developing sleeve 1*a*.

However, in the developing apparatus 3 using the magnetic seal member 7 as the end toner leakage preventing member, if an amount of magnetized toner is small or if the cohesive force between the toner particles is great, a width of the toner coated on the developer regulating member 6*a* by the magnetic seal member 7 becomes greater than the width of the magnetic seal member 7, with the result that the toner coated on the developer regulating member 6*a* and to be returned to the developing container leaks laterally toward ends of the developing sleeve 1*a* and the developer regulating member 6*a* at an edge portion of the magnetic seal member 7. Consequently, the toner may leak at end areas of the developing sleeve 1*a* and the developer regulating member 6*a* where the permanent magnets 1*b*, 6*b* are not located.

SUMMARY OF THE INVENTION

An object of the present invention is to provide a developing apparatus in which toner is prevented from leaking at an end portion of a developing container.

Another object of the present invention is to provide a developing apparatus in which toner leakage can be prevented regardless an amount of magnetized toner and an cohesive force.

A further object of the present invention is to provide a developing apparatus in which magnetic toner can regulated from shifting outwardly at edge portions near a regulating portion for regulating a thickness of developer on a developer bearing member.

The other objects and features of the present invention will be apparent from the following detailed explanation of the invention referring to the accompanying drawings.

DETAILED DESCRIPTION OF THE PREFERRED EMBODIMENTS

The present invention will now be explained in connection with embodiments thereof with reference to the accompanying drawings.

<First Embodiment>

Figure 1:
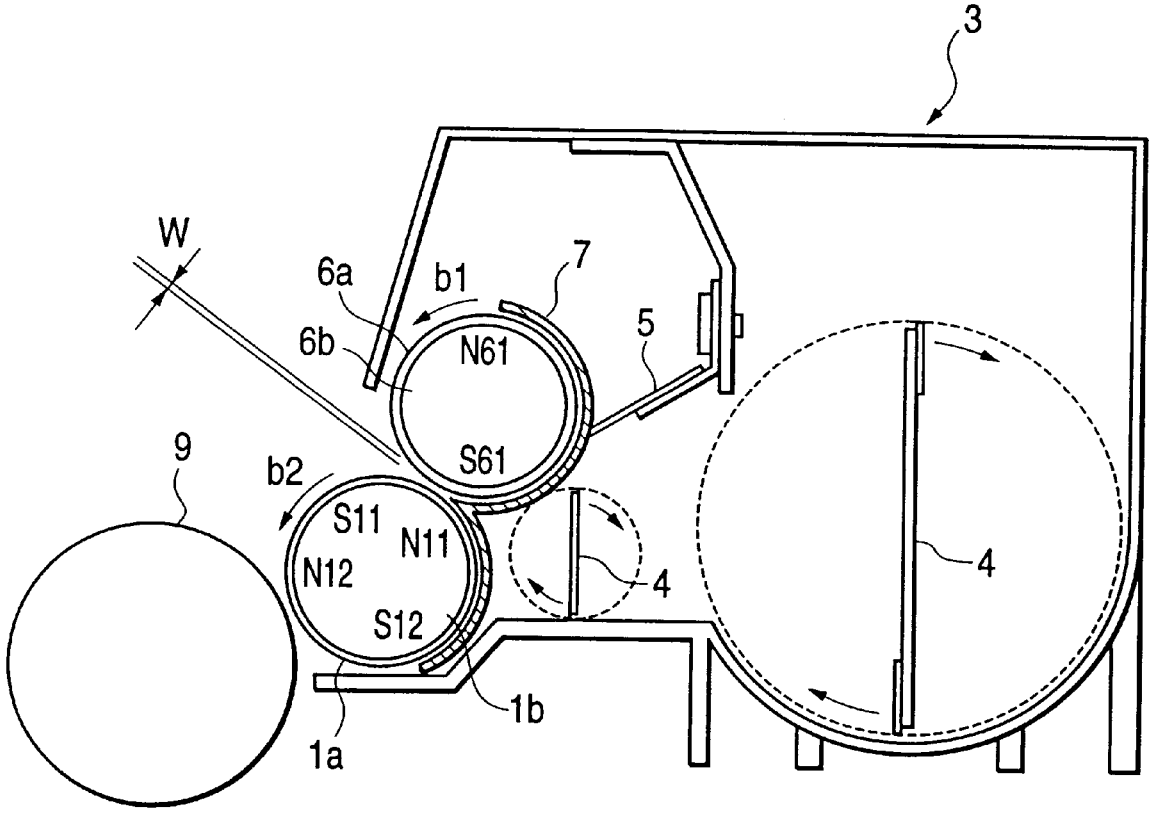
FIG. 1 is a sectional view of a developing apparatus according to a first embodiment of the present invention.

FIG. 1 is a sectional view of a developing apparatus 3 according to a first embodiment of the present invention. In FIG. 1, the developing apparatus comprises a developing sleeve (developer bearing member) 1*a* rotated in a direction shown by the arrow b2 and constituted by a non-magnetic metal member having a diameter of 20 mm, a permanent magnet 1*b* disposed within the developing sleeve 1*a*, a convey member 4 for agitating developer in the developing apparatus 3 and for conveying the developer toward the developing sleeve 1*a*, and a scraper 5 formed from a plate member made of urethane material and having a thickness of 1.2 mm. The developing apparatus further includes a developer regulating member 6*a* formed from a non-magnetic metal member having a diameter of 20 mm, a permanent magnet 6*b* disposed within the developer regulating member 6*a*, and a magnetic seal member 7 made of magnetic material. Incidentally, the reference numeral 9 denotes a photosensitive member as an electrostatic latent image bearing member.

The developer regulating member 6*a* is disposed in the vicinity of the developing sleeve 1*a* and can be rotated in a direction (shown by the arrow b1) same as the rotational direction b2 of the developing sleeve 1*a*.

In the illustrated embodiment, magnetic flux density of a magnetic pole S61 of the magnet 6*b* opposed to a magnetic pole N11 of the permanent magnet 1*b* with the interposition of a space (developer regulating portion) between the developing sleeve 1*a* and the developer regulating member 6*a* is selected to 800 Gauss and magnetic flux density of the magnetic pole N11 is selected to 900 Gauss, and a ratio of widths of areas representing values greater than 50% (conveniently, referred to as "50% value" hereinafter) to peak values of the magnetic flux densities of the magnetic poles S61, N11 is selected to 1.0 or less (i.e., (50% value of magnetic pole S61)/(50% value of magnetic pole N11) $\leqq 1.0$) and preferably 0.8 or less (i.e., (50% value of magnetic pole S61)/(50% value of magnetic pole N11) $<0.8$). In the illustrated embodiment, by setting to ((50% value of magnetic pole S61)/(50% value of magnetic pole N11)≅0.8), the magnetic flux density of a magnetic field generated between the magnetic pole S61 and the magnetic pole N11 is changed so that the magnetic flux density is increased along a direction directing from the developing sleeve 1*a* toward the developer regulating member 6*a*.

Figure 2:
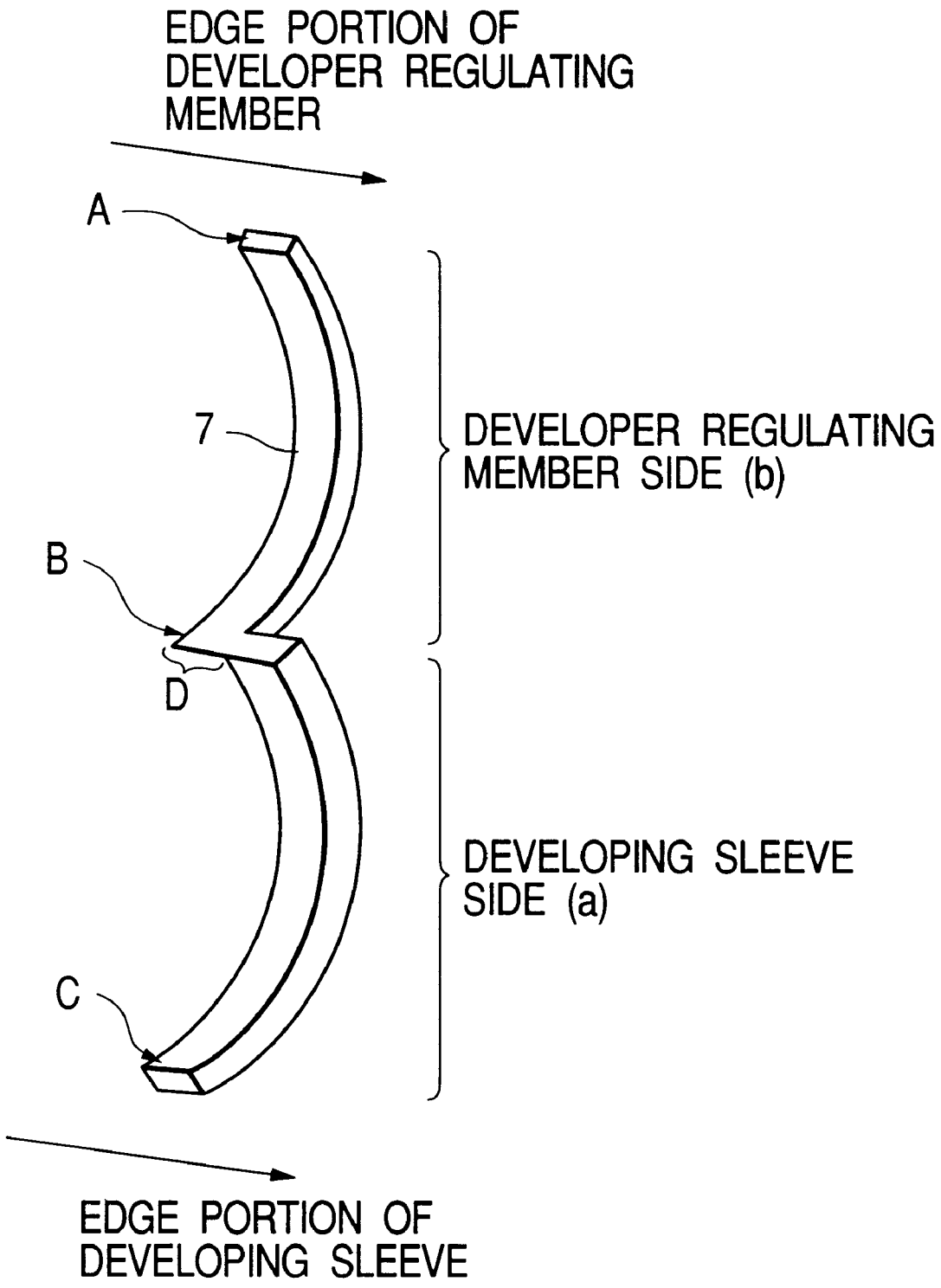
FIG. 2 is a perspective view of a magnetic seal member used in the developing apparatus according to the first embodiment of the present invention.

In the illustrated embodiment, as shown in FIG. 2, the magnetic seal member 7 is designed so that a developer regulating member 6*a* side portion (b) of the magnetic seal member is disposed (inside) nearer to the developing area than a developing sleeve 1*a* side portion (a) of the magnetic seal member in a rotation axis direction (longitudinal direction) of the developing sleeve 1*a*, and widths of the portions (a) and (b) are selected to 1.5 mm. Further, a distance W (refer to FIG. 1) between the developing sleeve 1*a* and the developer regulating member 6*a* is set to a range from 100 $\mu$m to 2 mm. In the illustrated embodiment, in the magnetic seal member 7, the developing sleeve 1*a* side portion (a) is integrally formed with the developer regulating member 6*a* side portion (b). The magnetic seal member 7 is opposed to the regulating member 6*a* and the sleeve 1*a* with gaps therebetween.

As magnetic toner, negative chargeable toner in which a weight average particle diameter is 5 $\mu$m or more and a weight of added magnetic body is greater than 10% of a weight of the magnetic toner is used.

In the developing apparatus 3 having the construction shown in FIG. 1, a conveying force the developer regulating member for conveying the developer toward the developing area is obtained as follows.

That is to say, the magnetic toner in the developing apparatus 3 is conveyed by the agitating member 4 toward the developing sleeve 1*a* and is held on the developing sleeve 1*a* by the permanent magnet 1*b*. In this case, the magnetic toner existing near the surface of the developing sleeve 1*a* is charged by friction between the toner and the surface of the developing sleeve 1*a*, and the charged magnetic toner is held on the surface of the developing sleeve 1*a* by a mirror symmetry force due to charges in the magnetic toner itself, and the sufficiently charged magnetic toner is conveyed toward the developing area by a mirror symmetry force depending upon the charged amount and a frictional force of the surface of the developing sleeve 1*a*, as the developing sleeve 1*a* is rotated.

On the other hand, in the developer regulating portion, a conveying force for conveying the developer toward a direction away from (opposite to) the developing area is obtained as follows.

That is to say, since the magnetic flux density is increased from the developing sleeve 1*a* to the developer regulating member 6*a*, the magnetic toner positioned between the developing sleeve 1*a* and the developer regulating member 6*a* is subjected to a magnetic force directing from the developing sleeve 1*a* to the developer regulating member 6*a*. Further, since the developer regulating member 6*a* is rotated in the direction shown by the arrow b1 (FIG. 1) same as the rotational direction of the developing sleeve 1*a*, the magnetic toner held on the surface of the developer regulating member 6*a* by the magnetic force is subjected to a conveying force directing from the developer regulating member 6*a* toward the interior of the developing apparatus 3 and generated by the force of the magnetic field and the frictional force between the toner and the surface of the developer regulating member 6*a*.

At ends of the developing sleeve 1*a* and the developer regulating member 6*a*, the magnetic force is concentrated on edge portions A, B, C of the magnetic seal member 7, with the result that the magnetic toner forms toner chains there, and, thus, is magnetically restrained. Due to the friction forces of the surface of the developing sleeve 1*a* and the developer regulating member 6*a* and pressure of the magnetic toner being conveyed, the magnetic toner forming the toner chains are coated on the surfaces of the developing sleeve 1*a* and the developer regulating member 6*a* in a strip pattern. The magnetic toner coating the surface of the developer regulating member 6*a* in the strip pattern is returned to the space (developer regulating portion) between the developing sleeve 1*a* and the developer regulating member 6*a* and is restrained again at the edge portion B of the magnetic seal member 7 in the space.

Figure 8:
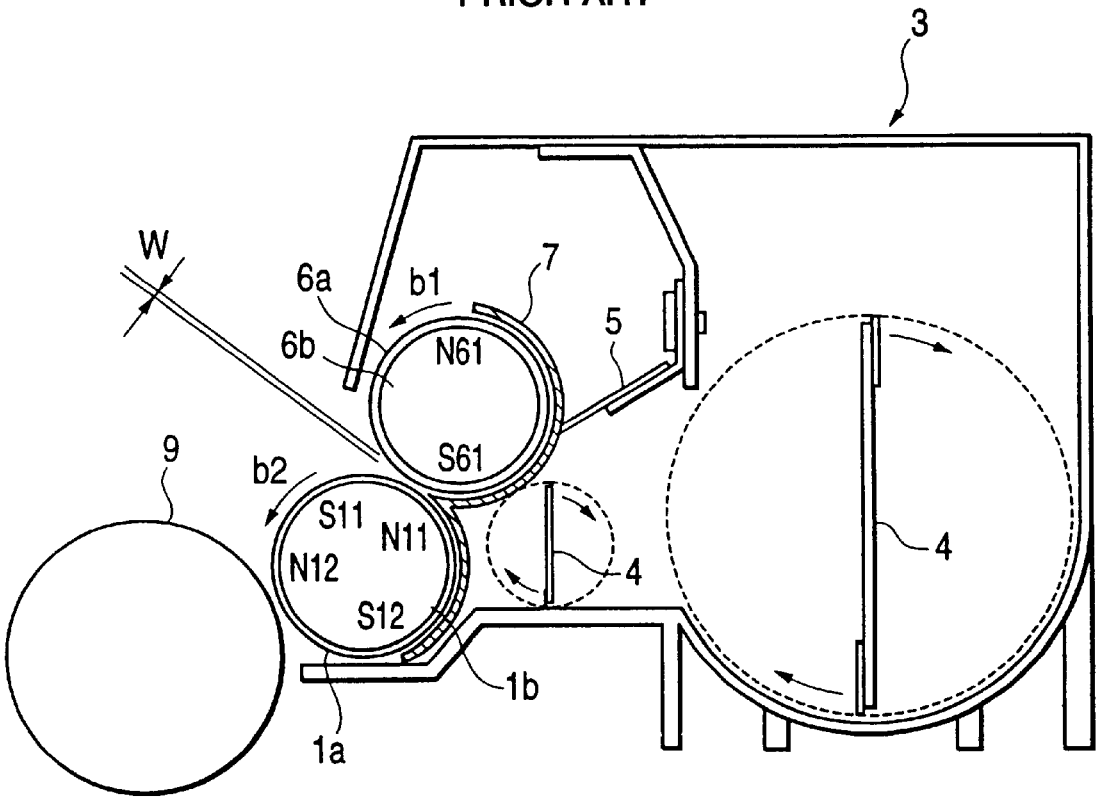
FIG. 8 PRIOR ART
FIG. 8 is a sectional view of a conventional developing apparatus.
Figure 9:
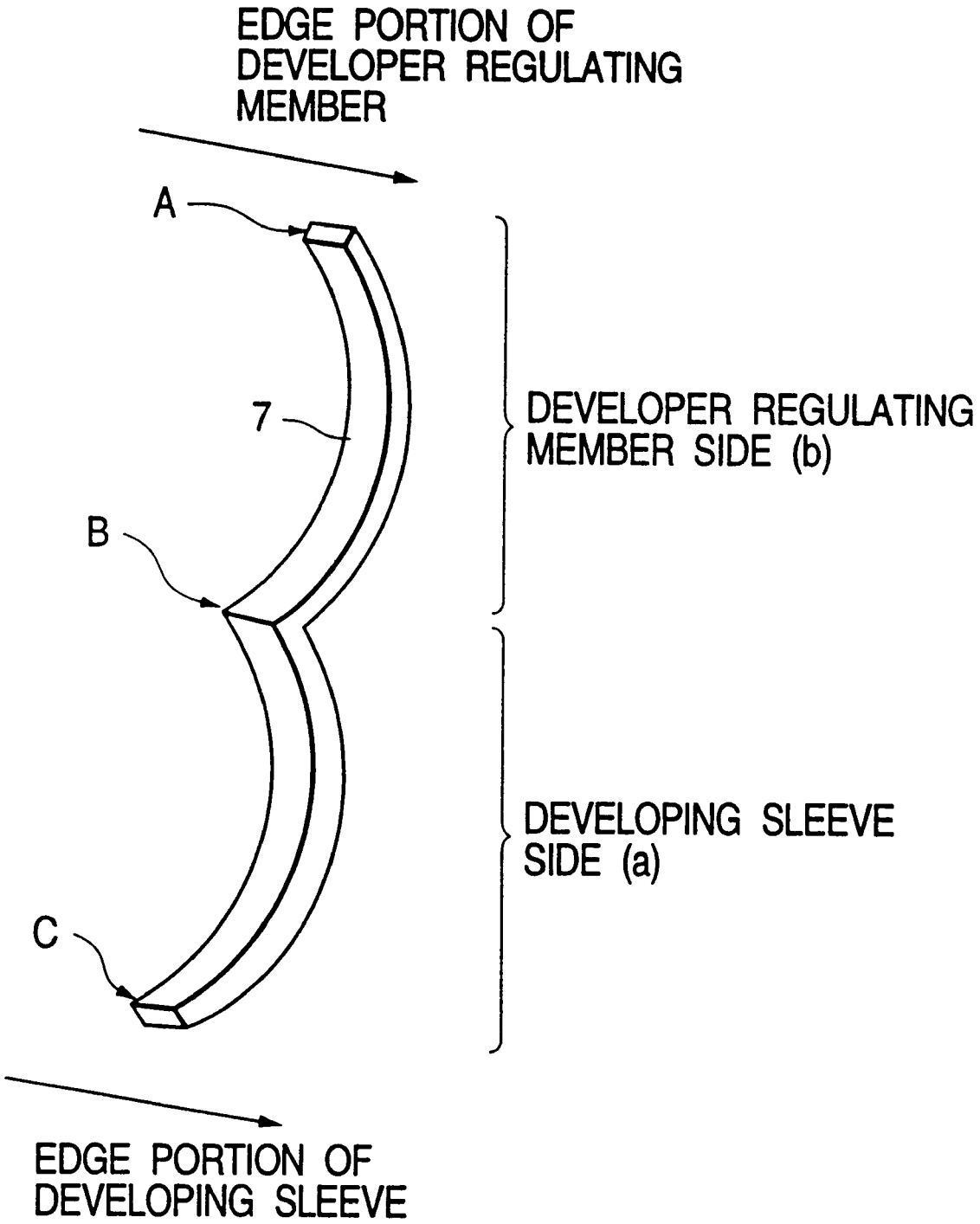
FIG. 9 PRIOR ART
FIG. 9 is a perspective view of a magnetic seal member used in the conventional developing apparatus.

When the magnetic toner coating the developer regulating member 6*a* in the strip pattern is returned to the edge portion B of the magnetic seal member 7, in the conventional magnetic seal member 7 (refer to FIGS. 8 and 9), at the edge portion B, the magnetic toner is coated on the developing sleeve 1*a* in the strip pattern in the same manner as the developer regulating member 6*a* as the developing sleeve 1*a* is rotated. The magnetic toner coated on the developing sleeve 1*a* in the strip pattern strikes against the magnetic toner coated on the developer regulating member 6*a* in the strip pattern at the edge portion B, with the result that the toner is pushed laterally at the developing sleeve 1*a* side of the magnetic seal member 7, which may result in end toner leakage.

However, in the illustrated embodiment as shown in FIG. 2, the magnetic toner coated on the developer regulating member 6*a* in the strip pattern is restrained inside (inside the developing container) at the edge portion B in the vicinity of the developer regulating portion when such magnetic toner is returned to the space between the developing sleeve 1*a* and the developer regulating member 6*a*. Thus, if such magnetic toner strikes against the strip-shaped magnetic toner coated on the developing sleeve 1*a* by the magnetic seal member 7, the strip-shaped magnetic toner coated on the developer regulating member 6*a* is pushed inside the developing container, thereby preventing the magnetic toner from leaking at the edges of the developing sleeve 1*a* side of the magnetic seal member 7. On the other hand, at the ends of the sleeve 1*a*, the magnetic toner born on the sleeve 1*a* is restrained at the portion D of the developer regulating 6*a* side of the magnetic seal member 7 in the vicinity of the developer regulating portion, thereby preventing the toner from leaking outside.

Accordingly, the end toner leakage from the developing container can be prevented regardless of the magnetized amount of the magnetic toner and the cohesive force.

<Second Embodiment>

Figure 3:
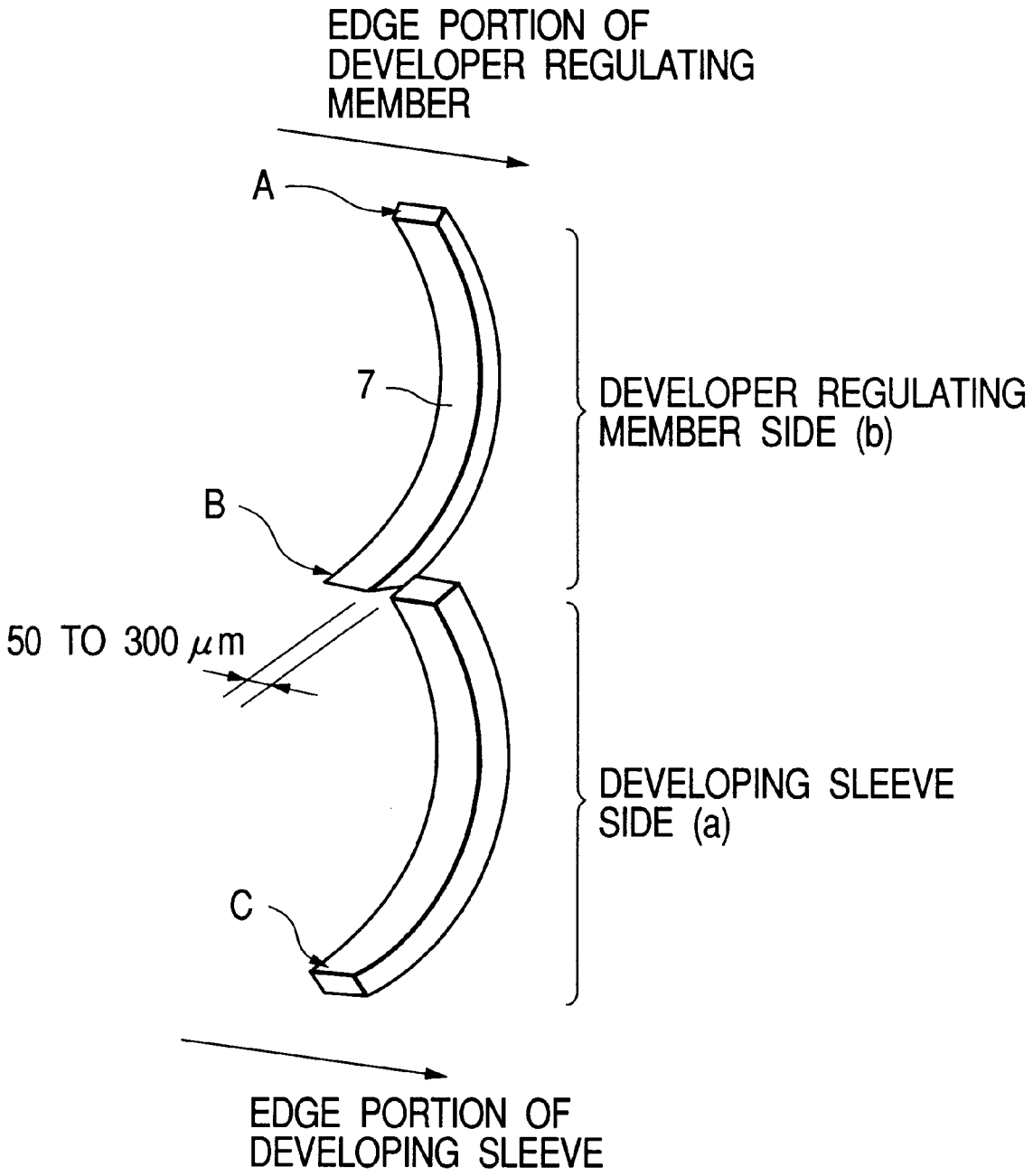
FIG. 3 is a perspective view of a magnetic seal member used in a developing apparatus according to a second embodiment of the present invention.

Next, a second embodiment of the present invention will be explained with reference to FIG. 3. Incidentally, FIG. 3 is a perspective view of a magnetic seal member used in a developing apparatus according to the second embodiment.

Since a construction of the developing apparatus 3 according to the second embodiment is the same as that in the first embodiment, the same elements shown in FIG. 1 are designated by the same reference numerals.

In a magnetic seal member 7 according to the second embodiment, a developing sleeve 1*a* side portion (a) and a developer regulating member 6*a* side portion (b) of the magnetic seal member are formed independently, and a gap between the portions (a) and (b) is selected to 50 to 300 $\mu$m. Further, widths of the portions (a) and (b) of the magnetic seal member 7 are both selected to 1.5 mm, and the portion (a) is disposed outside of the portion (b) in rotation axis directions (longitudinal directions) of the developing sleeve 1*a* and the developer regulating member 6*a*.

In this way, when the magnetic seal member 7 divided into two is used, the magnetic toners coated on the developing sleeve 1*a* and on the developer regulating member 6*a* in the strip pattern can completely be separated from each other, with the result that, even when a magnetized amount of the magnetic toner is set to a small value, the same technical advantage as that of the first embodiment can be obtained, thereby preventing end toner leakage.

<Third Embodiment>

Figure 4:
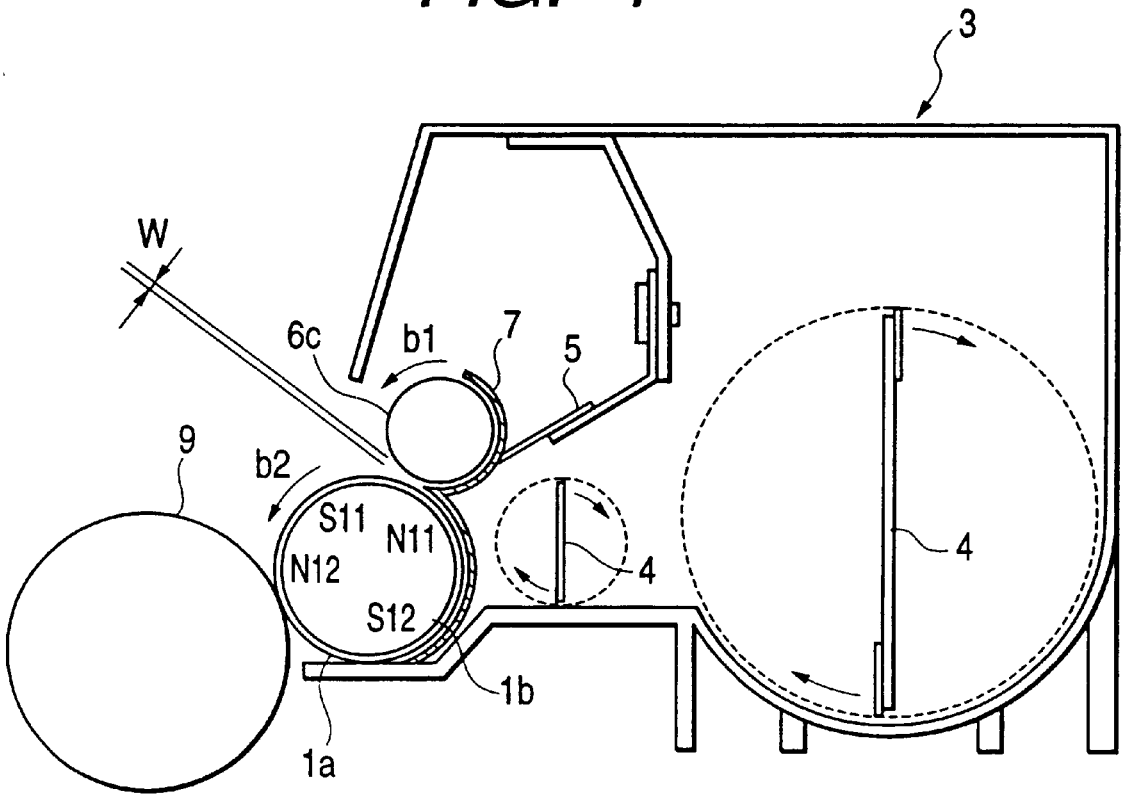
FIG. 4 is a sectional view of a developing apparatus according to a third embodiment of the present invention.
Figure 5:
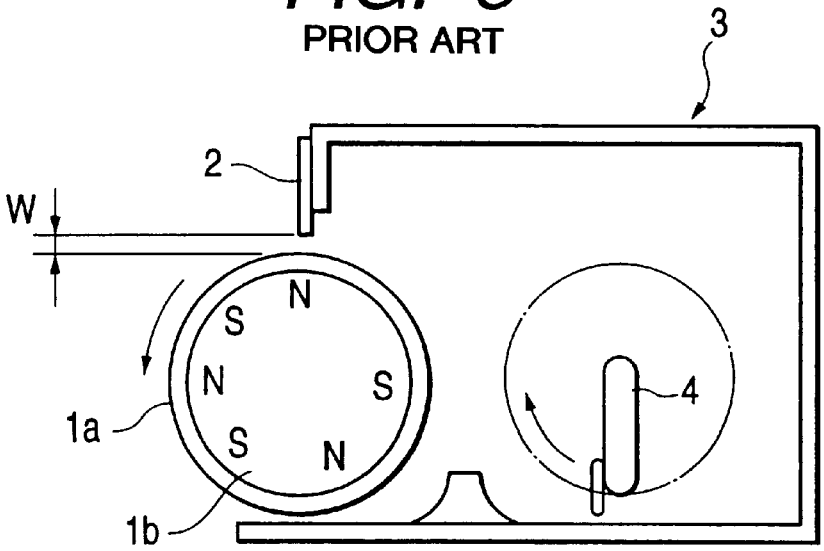
FIG. 5 PRIOR ART
FIG. 5 is a sectional view of a conventional developing apparatus.
Figure 6:
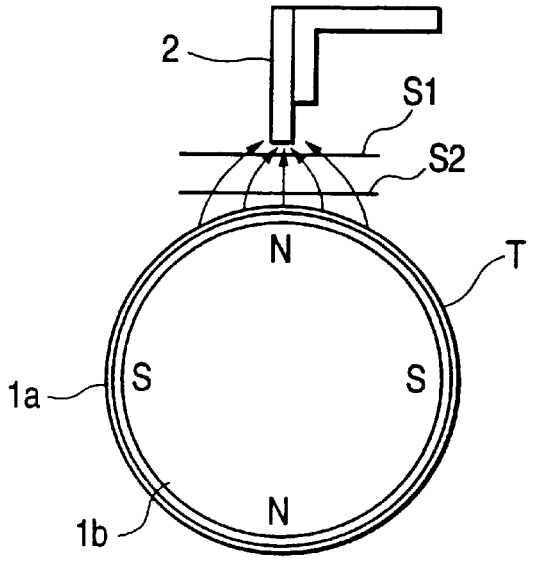
FIG. 6 PRIOR ART
FIG. 6 is a view for explaining magnetic flux density at a developer regulating portion.
Figure 7:
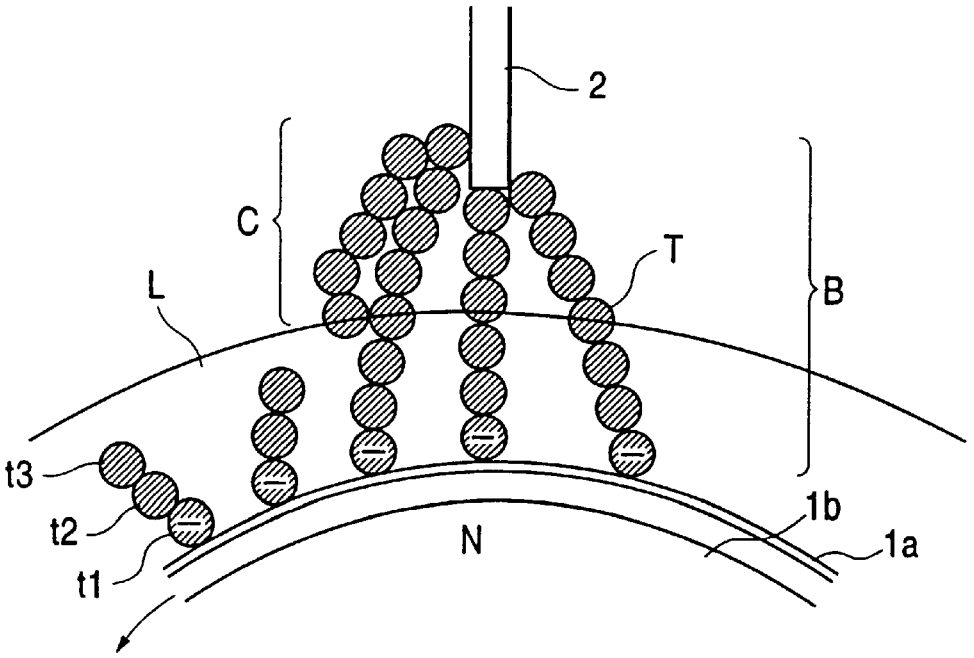
FIG. 7 PRIOR ART
FIG. 7 is a view for explaining movement of toner particles at the developer regulating portion.

Next, a third embodiment of the present invention will be explained with reference to FIG. 4. Incidentally, FIG. 4 is a sectional view of a developing apparatus 3 according to the third embodiment.

The developing apparatus 3 according to the third embodiment is the same as that of the first embodiment except for a developer regulating member 6*c*. The developer regulating member 6*c* is constituted by a magnetic metal member having a diameter of 10 mm and rotated in the same direction as the developing sleeve 1*a*.

Further, regarding a magnetic seal member 7 for preventing end toner leakage, similar to the second embodiment shown in FIG. 3, a developing sleeve 1*a* side portion (a) and a developer regulating 6*c* side portion (c) are formed independently, and the portion (a) is constituted by a permanent magnet and the portion (b) is constituted by a magnetic body.

Also in the third embodiment, the same technical advantages as those in the first and second embodiments, thereby preventing end toner leakage.

What is claimed is:

1. A developing apparatus comprising:

a rotatable developer bearing member for bearing and conveying developer including magnetic toner to a developing area where an electrostatic image formed on an image bearing member is developed with the magnetic toner, said developer bearing member having a magnet therein;

a rotatable developer regulating member for regulating a thickness of the developer on said developer bearing member at a developer regulating portion, said developer regulating member being rotated in a direction opposite to a rotational direction of said developer bearing member in the developer regulating portion and providing a magnetic force at the developer regulating portion, the magnet within said developer bearing member and the magnetic force of said developer regulating member forming a magnetic field at the developer regulating portion;

a first magnetic portion provided in an opposed relation to said developer bearing member in order to prevent the magnetic toner from leaking at ends of said developer bearing member in a rotation axis direction thereof; and a second magnetic portion provided in an opposed relation to said developer regulating member in order to prevent the magnetic toner from leaking at ends of said developer regulating member in a rotation axis direction thereof;

wherein, in the vicinity of the developer regulating portion, said second magnetic portion is disposed inwardly of said first magnetic portion in the rotation axis direction.

2. A developing apparatus according to claim 1, wherein said first magnetic portion is provided along a circumferential direction of said developer bearing member and said second magnetic portion is provided along a circumferential direction of said developer regulating member, and said second magnetic portion is disposed inwardly of said first magnetic portion in said rotation axis direction.

3. A developing apparatus according to claim 1, wherein said first and second magnetic portions are respectively formed as discrete members.

4. A developing apparatus according to claim 1, wherein said first and second magnetic portions are formed integrally with each other.

5. A developing apparatus according to claim 1, wherein said developer regulating member has a magnet therein, and, the magnet within said developer bearing member and the magnet within said developer regulating member form the magnetic field at the developer regulating portion.

6. A developing apparatus according to claim 5, wherein said developer bearing member is provided with a first magnetic pole therein in the vicinity of the developer regulating portion and said developer regulating member is provided with a second magnetic pole therein in the vicinity of the developer regulating portion, and further wherein a width of area having a value not less than 50% of a peak value of magnetic flux density of the first magnetic pole is smaller than a width of area having a value not less than 50% of a peak value of magnetic flux density of said second magnetic pole.

* * * * *

UNITED STATES PATENT AND TRADEMARK OFFICE

CERTIFICATE OF CORRECTION

PATENT NO. : 5,978,623

DATED : November 2, 1999

INVENTOR(S) : Isami ITOH

It is certified that error appears in the above-identified patent and that said Letters Patent is hereby corrected as shown below:

COLUMN 1:

Line 48, "forms" should read --form--.

COLUMN 2:

Line 32, "that" should read --the--.

COLUMN 4:

Line 61, "can regulated" should read --can be regulated--.

COLUMN 5:

Line 67, "<0.8)." should read --≤0.8).--.

Signed and Sealed this

Twenty-first Day of November, 2000

*Attest:*

Q. TODD DICKINSON

*Attesting Officer*

*Director of Patents and Trademarks*